US006049913A

United States Patent [19]

Harrigan, Jr.

[11] Patent Number: 6,049,913

[45] Date of Patent: Apr. 18, 2000

[54] WATERPROOF OUTER GARMENT

[76] Inventor: Charles M. Harrigan, Jr., 10180 Route 240, West Valley, N.Y. 14171-9718

[21] Appl. No.: 09/150,064

[22] Filed: Sep. 9, 1998

[51] Int. Cl.[7] ..... A41B 1/12; A41D 1/12; A41D 1/06; A62B 17/00; A62D 5/00

[52] U.S. Cl. ..... 2/227; 2/458; 2/70; 2/79; 2/228; 2/230

[58] Field of Search ..... 2/227, 456, 458, 2/2.15, 2.16, 2.17, 70, 71, 72, 79, 82, 83, 228, 230, 238, 114

[56] References Cited

U.S. PATENT DOCUMENTS

| | | |
|---|---|---|
| Re. 33,966 | 6/1992 | Robison . |
| 1,629,561 | 5/1927 | Wellstatter . |
| 1,993,568 | 3/1935 | Rosenberg . |
| 2,285,692 | 6/1942 | Wickman . |
| 2,292,227 | 8/1942 | Kopyto . |
| 2,570,428 | 10/1951 | Clifford . |
| 2,616,087 | 11/1952 | Werber . |
| 2,618,266 | 11/1952 | DeLeone . |
| 3,708,799 | 1/1973 | Smithdeal . |
| 3,800,330 | 4/1974 | Bowcut . |
| 4,068,315 | 1/1978 | Rainville . |
| 4,117,609 | 10/1978 | Helt . |
| 4,266,299 | 5/1981 | Beal . |
| 4,458,363 | 7/1984 | Harvey . |
| 4,638,509 | 1/1987 | Charron . |
| 5,008,962 | 4/1991 | Smith et al. . |
| 5,033,124 | 7/1991 | Bucalo et al. . |
| 5,083,316 | 1/1992 | Kuehner . |
| 5,105,474 | 4/1992 | Skinner . |
| 5,210,879 | 5/1993 | Miller . |
| 5,315,716 | 5/1994 | Baum . |
| 5,359,731 | 11/1994 | Cavalier . |
| 5,402,539 | 4/1995 | Hewitt . |
| 5,560,042 | 10/1996 | Schlesner . |
| 5,561,858 | 10/1996 | Poirier . |
| 5,864,888 | 2/1999 | Archer . |

*Primary Examiner*—John J. Calvert
*Assistant Examiner*—Shirra L. Jenkins
*Attorney, Agent, or Firm*—Lane, Aitken & McCann, L.L.P.

[57] ABSTRACT

A waterproof outer garment comprises one piece of material wrappable around the wearer between the knees and the back, with edges overlapping and securable to one another by quick locking and quick release fasteners. The edges are securable in varying amounts of overlap to adjust the garment to the size of the wearer, and suspenders prevent the garment slipping down on the wearer. In one embodiment, the entire garment is made from a material impervious to the ingress of water. In another embodiment, portions of the garment which are not subject to contact under pressure with snow and water are made of a lighter weight material which need not be waterproof. Garments according to the present invention which are made partly from non-waterproof material can be made lighter, more comfortable and perhaps more stylish than garments made entirely from waterproof material.

26 Claims, 5 Drawing Sheets

WATERPROOF OUTER GARMENT

BACKGROUND OF THE INVENTION

The present invention relates to a waterproof outer garment and , more particularly, to a waterproof outer garment for snowmobiling which can be put on over clothing and removed quickly and easily.

For some outdoor activities, especially snowmobiling, participants are subject to having their clothing become saturated with water, for example, from snow, particularly when the participants are seated. Their clothing becomes saturated with the water, leaving the wearers wet, cold and generally uncomfortable. The wetness also causes chafing. Snow comes in contact with the clothing of snowmobilers especially when freshly fallen snow is deep and light. As a snowmobile moves through such snow, the snow billows up and a back current carries the billowing snow and plasters it against the back of the rider. The snow works its way between the rider and the seat of the snowmobile, and body heat and the heat of compression as the rider bounces up and down on the seat melt the snow. Portions of the riders legs down almost to the knees are likely to make contact with the snowmobile seat and, therefore, are prone to getting wet.

Some waterproof garments are known, but they either cover an insufficient area of the wearer to prevent the wearer's clothing from getting wet or they are difficult to put on over clothing, such as a conventional snowmobile suit, and difficult to take off. Some waterproof garments require the wearer to step into each leg, which is made difficult by the wearer's boots and warm, bulky clothing, such as a snowmobile suit.

SUMMARY OF THE INVENTION

By the present invention, a waterproof outer garment covers the areas of a snowmobiler's clothing which are most likely to get wet, and yet the garment is quick and easy to put on and remove. The garment is a one-piece garment, made of a material which is impermeable to the ingress of water and substantially as flexible at temperatures well below freezing as it is at room temperature. Portions of the garment overlap one another as the garment is conformed to the contours of the wearer, and the amount of overlap is variable to adjust the size of the garment to the size of the wearer. Quickly securable and releasable fasteners, such as hook-and-loop fasteners, hold the garment in position on the wearer by maintaining the garment in any of the variable amounts of overlap, and suspenders keep the garment from slipping down. An access opening through the garment is provided adjacent to a crotch area of the garment, and other access openings are provided adjacent to pockets in the wearer's underlying clothing. A back support belt can be secured to the garment for the comfort and support of the wearer. In an alternate embodiment, portions of the garment which are not subject to contact under pressure with snow and water are made of a lighter weight material which need not be waterproof. Garments according to the present invention which are made partly from non-waterproof material can be made lighter, more comfortable and perhaps more stylish than garments made entirely from waterproof material.

DETAILED DESCRIPTION OF THE PREFERRED EMBODIMENT

Figure 1:
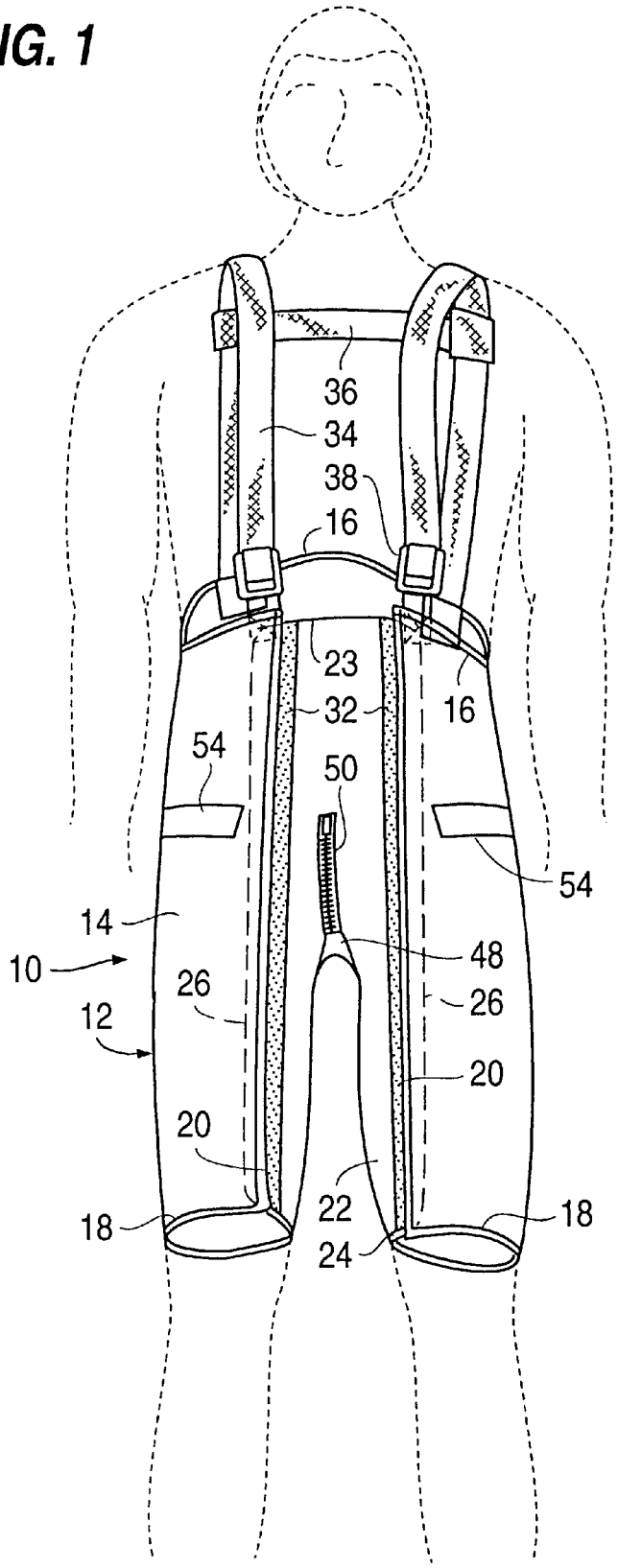
FIG. 1 is a front view of a first embodiment of the garment according to the present invention in place on a wearer.
Figure 2:
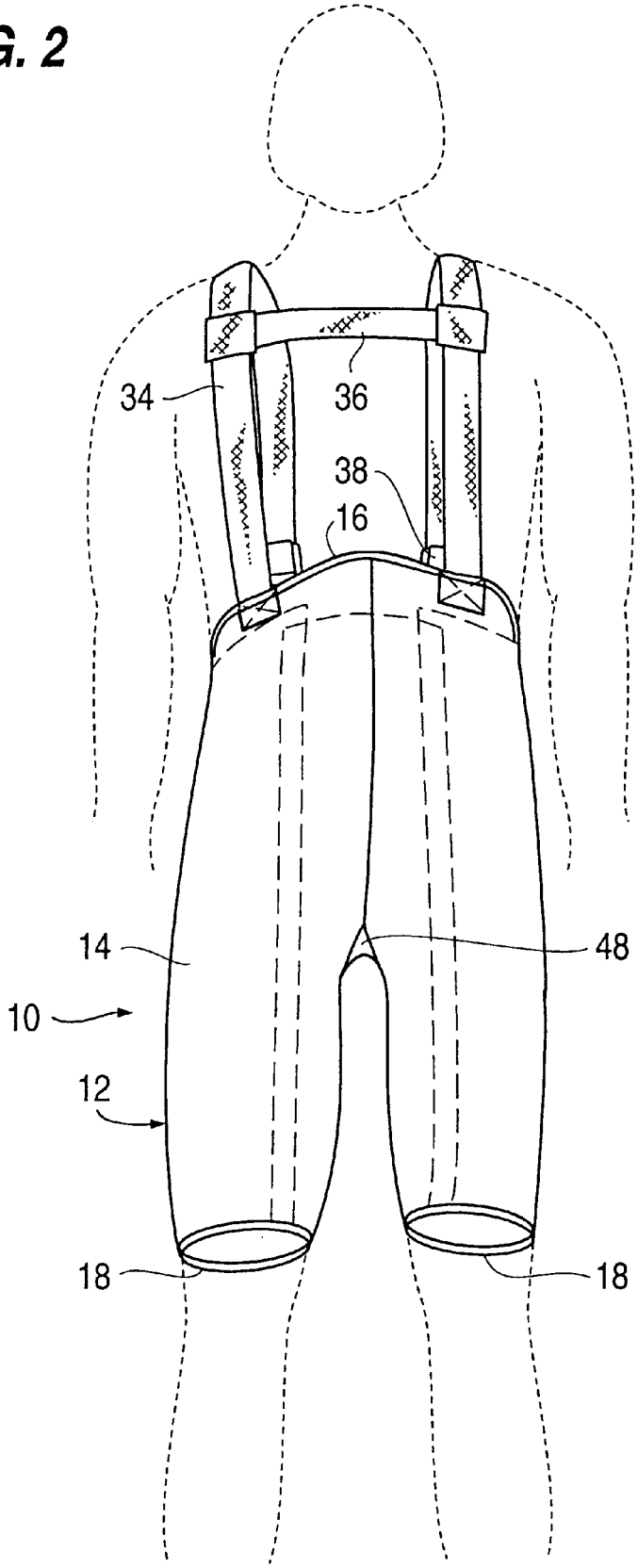
FIG. 2 is a back view of the garment of FIG. 1.
Figure 3:
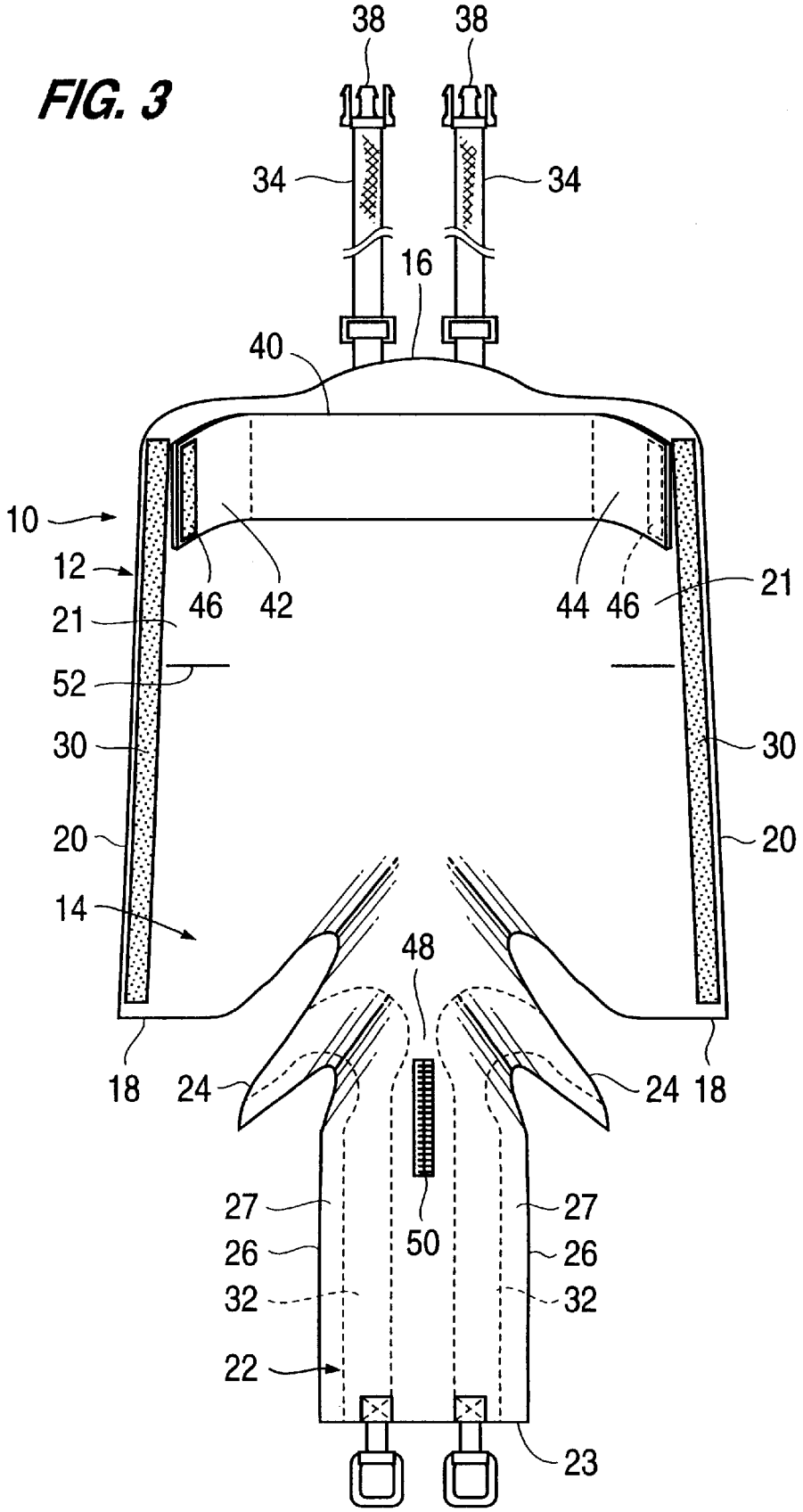
FIG. 3 is a plan view, showing the inside of the garment of FIG. 1 opened up and laid substantially flat.

As can be seen from FIGS. 1–3, a waterproof outer garment, which is designated generally by the reference numerical 10, is made of one piece of material 12 which wraps around the portions of the body of the wearer which are most likely to get wet when the wearer rides a snowmobile. It is understood that the garment 10 is worn over a conventional snowmobile suit or other warm clothing, which may be bulky, but for clarity of illustration the clothing has been omitted from the drawing figures. With most snowmobile suits, which comprise bib overalls and a jacket, the garment 10 is worn over the overalls and under the jacket. The term "one-piece" is used herein in the sense of a "one-piece" bathing suit, which may actually comprise two or more elements of material sewn together or otherwise permanently joined. The one-piece garment 10 according to the present invention can have seams, but such seams must be waterproof.

The piece of material 12 has a first side, visible in FIG. 3, defining an inner surface for facing a wearer and a second side opposite to the first side. The piece of material 12 includes a main portion 14 defining a top edge 16, a bottom edge 18, opposite side edges 20, and side regions 21 adjacent to the side edges 20. The piece of material 12 further includes a flap portion 22 integral with the main portion 14 at the bottom edge 18 and having a top edge 23, a bottom edge 24, opposite side edges 26, and side regions 27 adjacent to the side edges 26. As can be seen from FIGS. 1 and 2, when the garment 10 is in place on the wearer, the side regions 21 of the main portion 14 overlap side regions 27 of the flap portion 22 to define areas of overlap and entirely cover and enclose the clothes of the wearer from about 2 to about 4 inches above the knees to just under the rib cage. The side edges 20 of the main portion 14 are substantially equal in length to the side edges 26 of the flap portion 22 and, when the garment 10 is worn, the tops and bottoms of the side edges 20 are in substantial lateral alignment with the tops and bottoms, respectively, of the side edges 20, so that two vertical lines of engagement between the main portion 14 and the flap portion 22 are defined.

A strip 30 of a hook-and-loop fastener, which is commonly sold under the trademark Velcro, wherein the strip 30 is either a strip of hooks or a strip of loops, is secured on the inner surface of the main portion 14 in each of the side regions 21, extending the entire length of each side edge 20 of the main portion 14. Two corresponding strips 32 of hook-and-loop fasteners, either a strip of loops or a strip of hooks, depending on whether the strips 30 are hooks or loops, are secured parallel to one another on the outer surface of the flap portion 22, extending the entire length of the side edges 26 of the flap portion. The use of the strips 30 and 32 is particularly effective in providing a line of continuous contact between the overlapping edges and, thereby, preventing the ingress of water at the overlap. The strips 30 and 32 are releasable from one another merely by applying a separating force to the overlapping regions of the main portion 16 and the flap portion 22 in a direction generally perpendicular to the areas of overlap.

The width of either the strips 30 or the strips 32, or both, is greater than is necessary to secure the side regions 21 of the main portion 14 in overlapping relationship with the side regions 27 of the flap portion 22. As a result, the side regions 21 of the main portion 14 can be made to overlap the side regions 27 of the flap portion 22 by greater or lesser amounts, and the strips 30 and 32 will still securely fasten the main portion 14 to the flap portion 22 in overlapping relationship. Thus, the fit of the garment 10 is adjustable to accommodate wearers of various sizes. Although the hook-and-loop fasteners in the illustrated embodiment take the form of continuous strips parallel to the side edges of the garment 10, it is understood that other arrangements can be used, such as discrete areas of hook-and-loop fasteners, arranged along the side regions 21 and 27, including short strips extending perpendicular to the side edges 20 and 26 of the garment. Furthermore, other types of fasteners can be used, for example straps having snap-type buckles movably mounted thereon to adjust length. Such buckles are commonly used, for example, on baby strollers and children's car seats.

The garment 10 is made from a material which is waterproof, that is, impermeable to the ingress of water, and which has unhindered flexibility at temperatures well below freezing. A material which has these characteristics and is otherwise particularly well suited for the garment 10 is neoprene, which is used in wet suits and waders. In order to increase durability, the neoprene or other material can be covered with a strong material, such as a nylon material available from Du Pont under the trademark Cordura.

In order to keep the garment 10 from slipping down on the wearer, suspenders 34 which can include a cross strap 36 are provided. For quick securing and release of the suspenders 34, snap-type buckles 38 of the type described above as alternative fasteners for the garment 10 are provided. The garment 10 can include a back support belt 40 secured, for example, by sewing, to the inner surface of the main portion 14 in a position which is adjacent to the lower back of the wearer when the garment is worn. The back support belt 40 has ends 42 and 44 which are unattached to the garment 10 and which have fasteners 46, such as hook-and-loop fasteners, so that the ends of the belt 40 can be grasped by the wearer and secured to one another. The belt 40 can be made of a strong, elastic material. Even without the belt 40, the garment provides some back support.

The garment 10 includes a crotch portion 48 in the area of the juncture of the main portion 14 with the flap portion 22 and an access opening 50 through the flap portion 22 adjacent to the crotch portion 48, with the access opening 50 closable by a fastener, such as a zipper, to make urination more convenient. The garment 10 also defines one or more access openings 52 through the main portion 14 in places which are in alignment with front pants pockets when the garment is being worn. The access openings 52 can be covered by flaps 54. When most of the garment is laid flat, as in FIG. 3, portions of the main portion 14 and the flap portion 22 in the region of their juncture do not lie flat, but rather rise into large ridges adjacent to the crotch portion 48.

The garment according to the present invention can be made partly from material which is not waterproof. Areas of the garment which are likely to be forced into pressure contact with snow and water are made of a material which is impermeable to the ingress of water, but areas of the garment which are not likely to be subject to such pressure contact can be made of a material which is strong and durable, as well as less bulky, more breathable and even more flexible than the waterproof material. It is preferred that the non-waterproof material still be water-resistant, in that water tends to run off the material rather be absorbed. One material which has all of the above characteristics is Cordura nylon.

Figure 4:
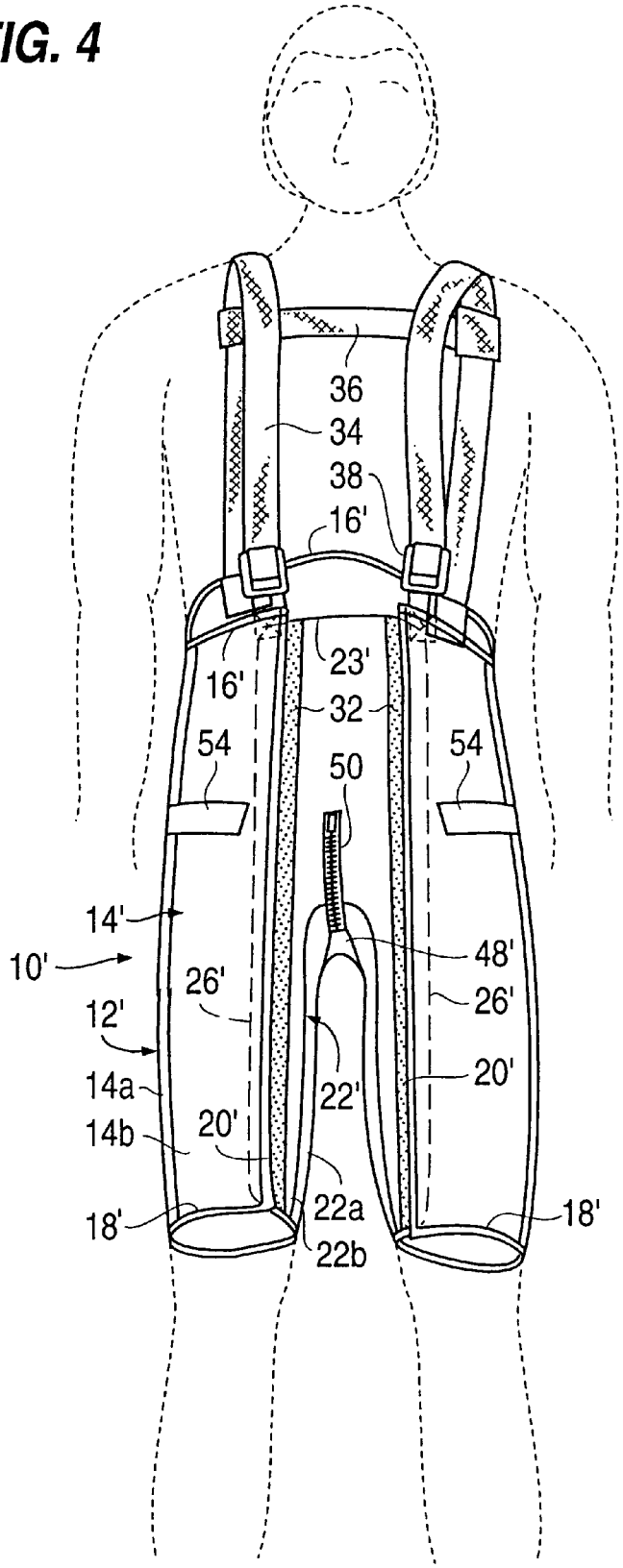
FIG. 4 is a front view of a second embodiment of the garment according to the present invention in place on a wearer.
Figure 5:
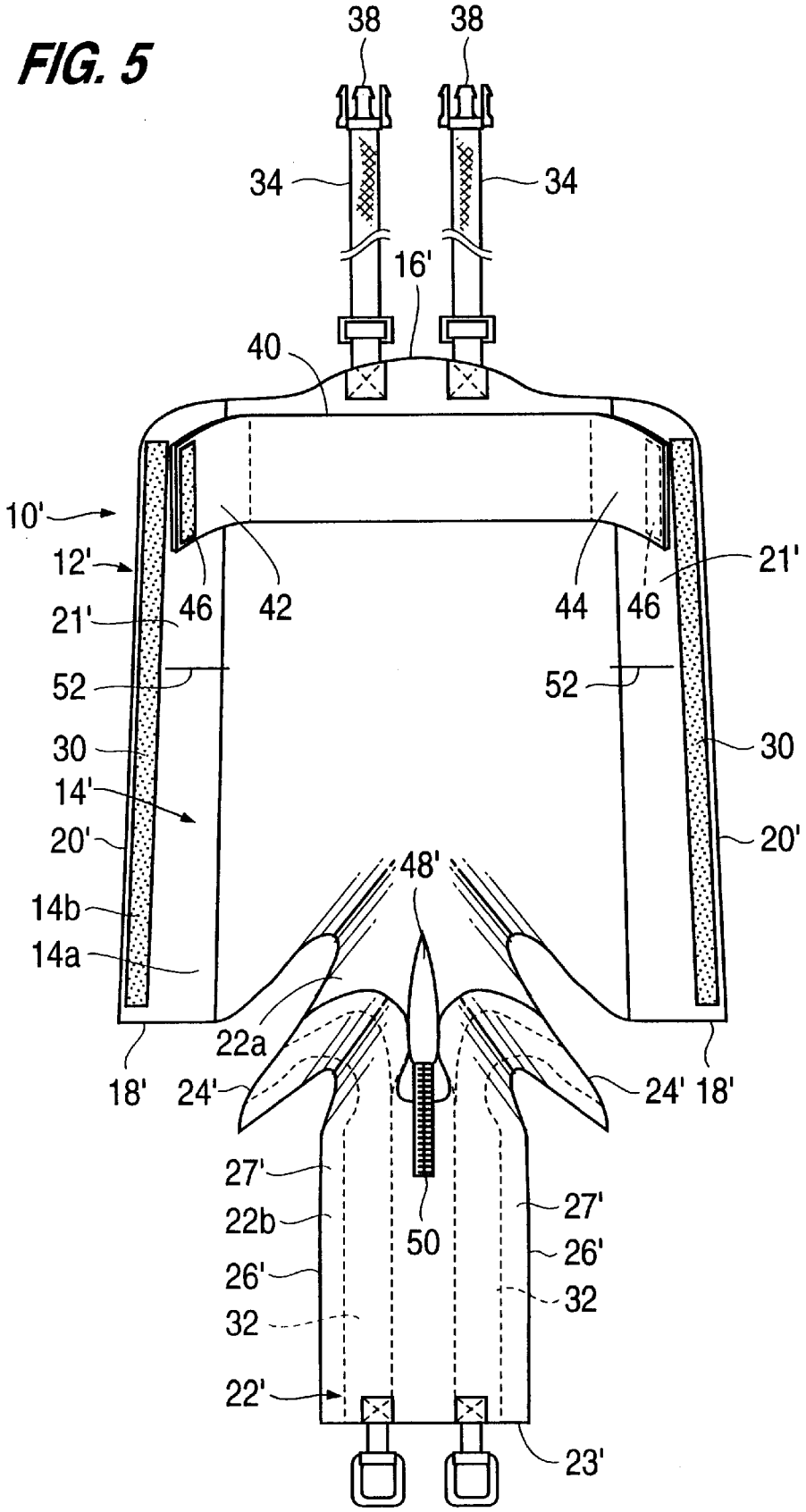
FIG. 5 is a plan view, showing the inside of the garment of FIG. 4 opened up and laid substantially flat.

As can be seen from FIGS. 4 and 5, a waterproof outer garment, which is designated generally by the reference numerical 10', is made of one piece of material 12'. The garment 10' is the same as the garment 10 of the embodiment of FIGS. 1–3, except that the piece of material 12' has some portions which are not waterproof, but instead are made of, for example, Cordura nylon. The piece of material 12' includes a main portion 14' defining a top edge 16', a bottom edge 18', opposite side edges 20', and side regions 21' adjacent to the side edges 20'. The piece of material 12' further includes a flap portion 22' integral with the main portion 14' at the bottom edge 18' and having a top edge 23', a bottom edge 24', opposite side edges 26', and side regions 27' adjacent to the side edges 26'. When the garment 10' is in place on the wearer, the side regions 21' of the main portion 14' overlap side regions 27' of the flap portion 22' to define areas of overlap.

The main portion 14' includes a main, central area **14*a* made of the waterproof material and two side areas 14*b* made of non-waterproof material. The side areas 14*b* are secured to the central area 14*a* by, for example, sewing. The flap portion 22' includes a lower area 22*a* made of the waterproof material and an upper area 22*b* made of a non-waterproof material and secured to the lower area. The juncture between the waterproof area 22*a* and the non-waterproof area 22*b* of the flap portion 22' extends to the bottom edges 24' from the access opening 50 adjacent to a crotch portion 48'. When the garment 10' is worn, the waterproof main, central area 14*a* of the main portion 14' extends from one hip of the wearer, around the back to the other hip, and under the buttocks and thighs to about halfway between the bottoms and the tops of the thighs, wherein "bottoms" and "tops" are defined by the position of the thighs when the wearer is seated. The waterproof lower area 22*a* of the flap portion 22' extends from under the buttocks and thighs to about halfway between the bottoms and tops of the thighs, on the inside of the thighs. The areas of wearer coverage not described above can be provided by the non-waterproof areas 14*b* and 22*b*. Any seams within the waterproof areas 14*a* and 22*b*** must be waterproof.

To put on the garment 10, for example, the garment can be picked up by the straps 34, and the straps pulled forward over the shoulder with the main portion 14 at the back and the flap portion 22 hanging down from the main portion. Then, with the straps 34 held in one hand, the top edge 23 is brought forward between the legs and lifted with the other hand. The buckles 38 are snap locked, and the garment is wrapped around each thigh, with the main portion 14 overlapping the flap portion 22. Then, the hook-and-loop strips 30 and 32 are smoothed into fastening engagement with one another. If a back support belt 40 is used, it can be secured before the garment 10 is wrapped around the thighs. To remove the garment 10, the strips 30 and 32 are separated, the buckles 38 released and the back support belt 40, if used, undone.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A waterproof outer garment for snowmobilers, comprising:

a piece of material having a first side defining an inner surface for facing a wearer, a second side opposite said first side and defining an outer surface, a main portion defining a top edge, a bottom edge, and opposite side edges, and a flap portion integral with said main portion at said bottom edge, said flap portion having a bottom edge and opposite side edges, wherein side regions of the main portion adjacent to each of the side edges of the main portion overlap respective side regions of the flap portion adjacent to the side edges of the flap portion to define areas of overlap, the garment entirely covers the wearer from approximately the knees to at least as high as the waist, and the garment has waterproof areas extending at least around the back and behind the buttocks and thighs of the wearer from approximately the knees of the wearer to the waist, the waterproof outer garment further comprising fastening means for holding the side regions of the main portion in overlapping relationship with the side regions of the flap portion, the fastening means comprising means for holding the side regions of the main flap in varying amounts of overlap relative to the side regions of the flap portion to adjust the fit of the garment to the size of the wearer.

2. The waterproof outer garment of claim 1, wherein the waterproof areas extend from one hip of the wearer, around the back to the other hip, and approximately halfway between the bottoms and the tops of the thighs, when the wearer is seated, on both the insides and the outsides of the thighs.

3. The waterproof outer garment of claim 1, wherein each of the side edges of the main portion has a first length, a top and a bottom; each of the side edges of the flap portion has a second length, a top and a bottom; said first length is substantially equal to said second length; the tops of the side edges of the main portion are substantially laterally aligned with the tops of the side edges of the flap portion; and the bottoms of the side edges of the main portion are substantially laterally aligned with the bottoms of the side edges of the flap portion.

4. The waterproof outer garment of claim 3, further comprising fastening means for holding the side regions of the main portion in overlapping relationship with the side regions of the flap portion, wherein said fastening means is releasable merely by a force applied to the overlapping regions of the main portion and the flap portion in a direction generally perpendicular to the areas of overlap.

5. The waterproof outer garment of claim 4, wherein said fastening means comprises hook-and-loop fasteners extending substantially the entire length of the side edges of the main portion and the flap portion.

6. The waterproof outer garment of claim 1, wherein said fastening means is releasable merely by a force applied to the overlapping regions of the main portion and the flap portion in a direction generally perpendicular to the areas of overlap.

7. The waterproof outer garment of claim 1, wherein said means for holding comprises areas of hook fasteners adjacent to the side edges of one of the main portion and the flap portion and areas of loop fasteners adjacent to the side edges of the other of the main portion and the flap portion, at least some of said areas of hook fasteners and areas of loop fasteners having a dimension perpendicular to the adjacent side edges greater than required to hold the side regions of the main portion in overlapping relationship with the side regions of the flap portion, whereby positioning of the areas of hook fasteners relative to the areas of loop fasteners can be varied to adjust the fit of the garment to the size of the wearer.

8. The waterproof garment of claim 1, wherein the waterproof areas are made of a material impermeable to water.

9. The waterproof garment of claim 1, wherein waterproof areas are made of neoprene.

10. The waterproof garment of claim 1, further comprising means for preventing the garment slipping down on the wearer.

11. The waterproof garment of claim 10, wherein the means for preventing the garment slipping down comprises suspenders.

12. A waterproof outer garment for snowmobilers, comprising:

a piece of material having a first side defining an inner surface for facing a wearer, a second side opposite said first side and defining an outer surface, a main portion defining a top edge, a bottom edge, and opposite side edges, and a flap portion integral with said main portion at said bottom edge, said flap portion having a bottom edge and opposite side edges, wherein side regions of the main portion adjacent to each of the side edges of the main portion overlap respective side regions of the flap portion adjacent to the side edges of the flap portion to define areas of overlap, the garment entirely covers the wearer from approximately the knees to at least as high as the waist, and the garment has waterproof areas extending at least around the back and behind the buttocks and thighs of the wearer from approximately the knees of the wearer to the waist, the waterproof garment further comprising a back support belt attached to said piece of material in a position to engage the back of the wearer.

13. The waterproof garment of claim 12, wherein said back support belt has ends unattached to said piece of material and means for securing said back support belt around said wearer.

14. The waterproof garment of claim 1, wherein the top edge of the main portion is sufficiently above the bottom edge of the main portion to be positioned at about the bottom of the rib cage of the wearer.

15. The waterproof garment of claim 1, wherein a crotch portion is defined in the garment in an area of a juncture between the main portion and the flap portion, an access opening is defined through the flap portion adjacent to said crotch portion, and a releasable fastener is secured to the flap portion to close the access opening.

16. A waterproof outer garment for snowmobilers, comprising:

a piece of material having a first side defining an inner surface for facing a wearer, a second side opposite said first side and defining an outer surface, a main portion defining a top edge, a bottom edge, and opposite side edges, and a flap portion integral with said main portion at said bottom edge, said flap portion having a bottom edge and opposite side edges, wherein side regions of the main portion adjacent to each of the side edges of the main portion overlap respective side regions of the flap portion adjacent to the side edges of the flap portion to define areas of overlap, the garment entirely covers the wearer from approximately the knees to at least as high as the waist, and the garment has waterproof areas extending at least around the back and behind the buttocks and thighs of the wearer from approximately the knees of the wearer to the waist, the waterproof garment further comprising at least one access opening defined in said main portion in a position in which the access opening is in alignment with the position on the wearer of a conventional pants front pocket.

17. The waterproof garment of claim 1, wherein the piece of material is made entirely of a material impervious to water.

18. The waterproof outer garment of claim 1, further comprising fasteners having first portions fixed to the main portion of the garment and second portions affixed to the flap portion of the garment, the first and second portions being releasably securable to one another in variable positions to hold the side regions of the main portion in varying amounts of overlap relative to the side regions of the flap portion to adjust the fit of the garment to the size of the wearer.

19. The waterproof outer garment of claim 18, wherein one of said first portions and said second portions comprise areas of hook fasteners, and the other of said first portions and said second portions comprise areas of loop fasteners, some of said areas of hook fasteners and areas of loop fasteners having a dimension perpendicular to the adjacent side edges of the main portion and the flap portion that is greater than required to hold the side regions of the main portion in overlapping relationship with the side regions of the flap portion, whereby positioning of the areas of hook fasteners relative to the areas of the loop fasteners can be varied to adjust the fit of the garment to the size of the wearer.

20. The waterproof outer garment of claim 19, wherein said first portions cover an area extending from the top edge of the main portion to the bottom edge of the main portion.

21. The waterproof outer garment of claim 19, wherein said second portions cover an area extending from the top edge of the flap portion to the bottom edge of the flap portion.

22. The waterproof outer garment of claim 21, wherein said first portions cover an area extending from the top edge of the main portion to the bottom edge of the main portion.

23. The waterproof outer garment of claim 19, wherein said first portions are fixed at the side edges of the main portion.

24. The waterproof outer garment of claim 18, wherein said first portions are releasable from said second portions merely by a force applied to the overlapping regions of the main portion and the flap portion in a direction generally perpendicular to the areas of overlap.

25. The waterproof outer garment of claim 1, further comprising fasteners, including a fastener having a first portion fixed to the main portion of the garment at the bottom edge of the main portion and a second portion affixed to the flap portion at the bottom edge of the flap portion, the first and second portions being releasably securable to one another to hold the side regions of the main portion in overlapping relationship with the side regions of the flap portion.

26. The waterproof outer garment of claim 25, wherein the fasteners including a fastener having a first portion fixed to the main portion of the garment at the top edge of the main portion and a second portion fixed to the top edge of the flap portion, the first and second portions being securable to one another.

* * * * *